US005287961A

United States Patent [19]

Herran

[11] Patent Number: 5,287,961

[45] Date of Patent: Feb. 22, 1994

[54] MULTI-COMPARTMENT PACKAGE HAVING IMPROVED PARTITION STRIP

[75] Inventor: Vincent W. Herran, Greenville, S.C.

[73] Assignee: W.R. Grace & Co.-Conn., Duncan, S.C.

[21] Appl. No.: 965,834

[22] Filed: Oct. 23, 1992

[51] Int. Cl.[5] ..... B65D 81/32

[52] U.S. Cl. ..... 206/219; 206/484

[58] Field of Search ..... 206/219-222, 206/484, 568; 383/38

[56] References Cited

U.S. PATENT DOCUMENTS

| | | | |
|---|---|---|---|
| 2,885,104 | 5/1959 | Greenspan | 206/219 |
| 2,932,385 | 4/1960 | Bollmeier et al. | 206/219 |
| 2,971,850 | 2/1961 | Barton | 99/171 |
| 3,074,544 | 1/1963 | Bollmeier et al. | 206/219 |
| 3,294,227 | 12/1966 | Schneider et al. | 206/219 |
| 3,608,709 | 9/1971 | Pike | 206/219 |
| 3,809,224 | 5/1974 | Greenwood | 206/219 |
| 4,145,449 | 3/1979 | Nelham | 426/120 |
| 4,402,402 | 9/1983 | Pike | 206/219 |
| 4,458,811 | 7/1984 | Wilkinson | 206/219 |
| 4,462,224 | 7/1984 | Dunshee et al. | 206/219 |
| 4,496,046 | 1/1985 | Stone et al. | 206/219 |
| 4,519,499 | 5/1985 | Stone et al. | 206/219 |
| 4,806,371 | 2/1989 | Mendenhall | 426/113 |
| 4,851,246 | 7/1989 | Maxwell et al. | 426/107 |
| 4,961,495 | 10/1990 | Yoshida | 206/219 |
| 5,069,773 | 12/1991 | Frangioni | 204/299 |

FOREIGN PATENT DOCUMENTS

| | | | |
|---|---|---|---|
| 0581058 | 10/1976 | Switzerland | 206/219 |

*Primary Examiner*—Jimmy G. Foster

*Attorney, Agent, or Firm*—William D. Lee, Jr.; Mark B. Quatt

[57] ABSTRACT

A multi-compartment flexible package is provided for filling with products which are to be stored separately from each other. A multi-compartment package made from flexible thermoplastic material heat sealed at the peripheral edges is provided. The compartments are formed by rupturable partition strips heat sealed in place between the sheets of thermoplastic material forming the package. The partition strips are comprised of at least one layer of heat sealable material which is different from the thermoplastic material and which can be ruptured under pressure allowing the products in the compartments to mix.

8 Claims, 1 Drawing Sheet

MULTI-COMPARTMENT PACKAGE HAVING IMPROVED PARTITION STRIP

BACKGROUND OF THE INVENTION (1) Field of the Invention

This invention relates to a multi-compartment flexible package. More particularly, this invention relates to improvements in multi-compartment packages having an easily rupturable partition strip forming a seal between the compartments wherein two or more products which are to be mixed together are packaged in separate compartments.

(2) Description of the Prior Art

It is often desirable to have products packaged in separate packaging for later mixing. Such packaging is advantageous where the several products have a short shelf life and are mixed shortly before use is desired. One example of such a package is the scavenger packet disclosed in U.S. Pat. No. 2,971,850 to Barton. Barton discloses a multi-compartment package whereby one of the components is separated from the others by a membrane. The Barton package comprises in one compartment an enzyme system having glucose oxidase activity and in the other compartment a substrate for the enzyme. The package is constructed of a gas-permeable, water-impermeable film. The products in the Barton package are activated immediately prior to use by the application of pressure to rupture the membrane.

Another example of use of multi-compartment packages is disclosed in U.S. Pat. No. 2,932,385 to Bollmeier, et al., which discloses a multi-compartment package for components such as a liquid epoxy resin and a liquid organic polysulfide polymer having an activator. This package has an internal breaker strip that is less strong than the heat seal around the peripheral edge. The breaker strip may be produced from a variety of materials or combination of materials that bond with the film forming the package to form an effective heat seal having less resistance to rupture than the heat seal of either material to itself.

Package manufacturers have experienced difficulties in developing suitable barrier seals and consequently have resorted to somewhat elaborate means to develop multi-compartmented packaging systems. As an example, U.S. Pat. No. 3,809,224 to Greenwood uses a linear clamp seal to separate the two compartments. Another example is shown in U.S. Pat. No. 4,402,402 to Pike which shows a multi-compartmented bag having a plurality of seal forming compartments with one or more compartments being empty to prevent mixing by products leaking through the seal.

SUMMARY OF THE INVENTION

In view of the obvious desirability of providing products in multi-compartmented packages, it is an object of this invention to provide a package of flexible film permanently sealed around its peripheral edges and divided into compartments by easy to open heat sealed partition strips.

Another object of this invention is to provide multi-compartmented packaging wherein the compartments are separated by one or more partition strips of material that is a dissimilar material from the packaging material and is heat sealed in place to provide separate compartments with the partition strip being readily ruptured.

Yet another object is to provide a multi-compartmented package having the compartments separated by at least one heat sealed partition strip that while suitable to keep the products in the compartments separated, may be ruptured with a minimal effort without rupturing the permanent peripheral seals.

These and other objects of the present invention will become apparent to those skilled in the art as the description proceeds.

The multi-compartmented package of this invention is made of thin, impervious flexible thermoplastic material that is suitable for filling each compartment with materials which are to be stored in isolation from each other. The package is formed of two sheets of the thermoplastic film material positioned in overlying relationship and permanently heat sealed on three of the peripheral edges to form a pouch having one end open for filling.

At least one easy open partition strip is positioned at a predetermined location within the pouch to form compartments of appropriate size depending upon the materials to be packaged between the sheets of thermoplastic film to form a pouch having at least two separate compartments. In one embodiment of this invention the partition strip comprises a layer of heat sealable resin which is a blend of polypropylene, polybutylene, or linear low density polyethylene. In another embodiment the partition strip comprises at least two dissimilar layers of heat sealable resins with one layer being the resin composition described for the single layer and the other layer being a linear low density polyethylene. The partition strip is then heat sealed in place to form the compartments having an open end for filling. Each compartment may then be filled with whatever materials are to be stored. The open ended side of the multi-compartmented package is then heated sealed to form a fully closed package.

When the multi-compartmented package is ready for use, the partition strip is broken by simply squeezing the package with sufficient pressure to rupture the seal formed by the partition strip. Once the seal has been ruptured, the contents may be chemically mixed or may be mechanically mixed by shaking, squeezing or the like. The mixed product is then made available by cutting off a corner of the package and either permitting the material to flow out of the cut corner or squeezing the package to force the mixed product out of the pouch.

The advantage of the easy open partition strip is that the permanent perimeter seal strength can be unaffected by the less permanent easy open sealant resin used in the strip. To illustrate the differences in sealing strength between the peripheral seals and the partition seal, the high pressure perimeter seal can withstand up to 50 or more inches of water pressure while the partition seal may be ruptured at much lower pressures, i.e., below 50 inches of water.

BRIEF DESCRIPTION OF THE DRAWINGS

The present invention will be more fully understood from the following description when taken in connection with the accompanying drawings in which.

DESCRIPTION OF THE PREFERRED EMBODIMENT

Figure 1:
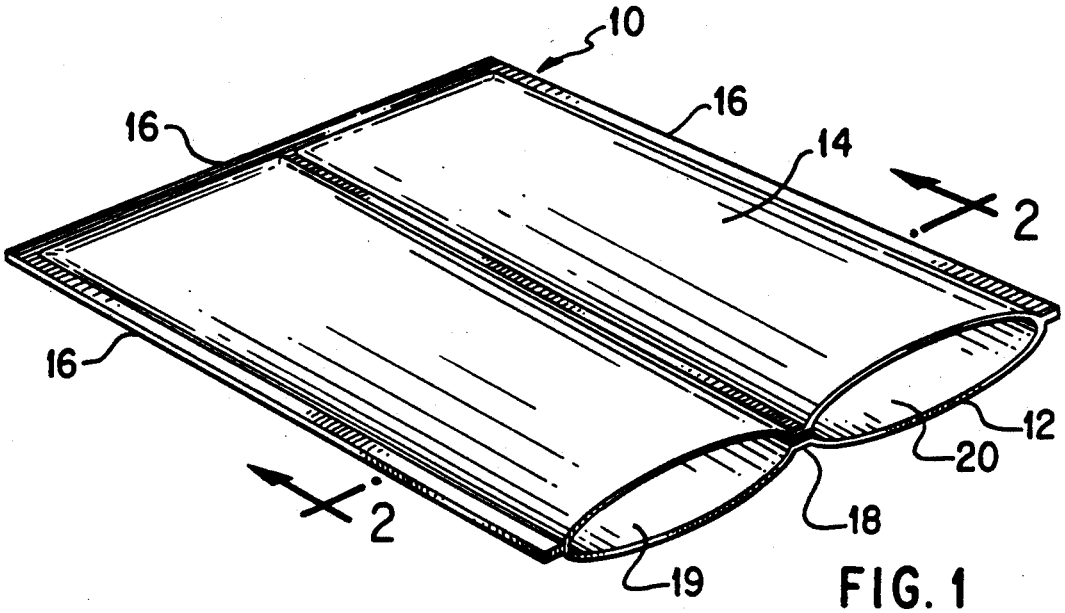
FIG. 1 is an isometric view of a multi-compartment package of the present invention showing two compartments.

With reference to the drawings, in FIG. 1 there is shown a multi-compartment package 10, in the form of a generally flat rectangular pouch-like shape formed of juxtaposed layers 12, 14 of thin, flexible, impervious thermoplastic material.

The thermoplastic material used to form the packages is provided in sheet or film form and may be any of the films used for this type of packaging. For example, the thermoplastic film may be polyolefin films from polymers of olefins, such as ethylene, propylene, butylene, and the like. More often, however, the film will be a commercially available multi-layer film having a sealant layer, a barrier layer and one or more strength layers. The particular multi-layered film used will in part depend upon the end use of the package. A preferred material for the strength layers is a polyamide such as biax nylon from 0.5 mil to about 1.5 mils in thickness. Where barrier properties are desired a layer of polyvinylidene chloride (PVDC) or copolymer of ethylene vinyl alcohol (EVOH) may be used. The sealant layer may be any other of the well known Polymers suitable for that purpose such as ethylene vinylacetate, low density polyethylene, linear low density polyethylene, or an ionomer such as Surlyn ® (DuPont).

The films may be coextruded or laminated and may be adhered together with a coextruded tie layer such as ethylene vinylacetate, an ionomer, anhydride grafted ethylene vinylacetate, low density polyethylene or linear low density polyethylene. The typical film to film bond from lamination is made by adhering the films together with a thin layer of polyurethane coating on an adhesive laminator. This lamination can also be accomplished by extrusion lamination or extrusion coating with an adhesive coextrusion tie layer type resin at the bond interface. The multi-layered films are typically from 0.75 mils to 5.0 mils thick, preferably about 1.5 to about 3.0 mils thick.

The package of the present invention is formed by sealing the sheets of thermoplastic material together by positioning a first layer of over a second layer of material and forming a permanent heat seal 16 around the peripheral edge of three sides thereof using well known heat sealing techniques to form a pouch. One side of the pouch is left unsealed so at least one partition strip may be placed within the pouch to form separate compartments. In another embodiment of the present invention layers 12 and 14 may form a package by folding a single sheet of thermoplastic material on itself and heat sealing two of the sides. A still further variation employs extruded tubular film to form the pouch by heat sealing across the bottom.

Figure 2:
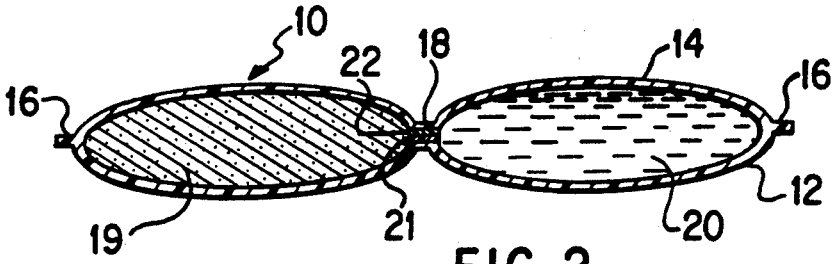
FIG. 2 is a cross-sectional view of a multi-compartment package of the present invention taken along section line 2—2 of FIG. 1.

As may be seen in FIGS. 1 and 2, a partition strip 18 is provided within the pouch formed by the thermoplastic films. A rupturable seal is formed using the partition strip between film layers 12 and 14 by sealing the partition strip in predetermined location within the pouch from top to bottom, separating the interior of the pouch into two individual elongated compartments having openings 19 and 20. Of course, the partition strip may be placed at any suitable location within the pouch and its position will depend upon the relative amounts of materials to be packaged. After filling each compartment, the top of the package is heat sealed to permanently enclose each compartment and store the products separately from each other.

In one embodiment the easy open partition strip is a layer of heat sealable resin material comprising a blend of polypropylene, polybutylene, or linear low density polyethylene. A preferred polyolefin formulation of the resin layer is about 2% to about 10% polypropylene, from about 5% to about 30% polybutylene, and from about 60% to about 93% linear low density polyethylene. In a most preferred embodiment the resin layer formulation comprises about 5% polypropylene, about 15% polybutylene, and 80% linear low density polyethylene. The breaking strength of the partition strip will depend upon the formulation of the resin layer. EVOH, PVDC, nylon, or ionomer may also be used in the strip.

In the alternative embodiment shown in FIG. 2 partition strip is a two-layer strip of heat sealable resin material. One layer, shown at 21 in FIG. 2, is a linear low density polyethylene and the other layer, shown at 22 in FIG. 2 is a blend of polypropylene, polybutylene, and linear low density polyethylene such as the layer described for the single layer partition strip. The other layer is a linear low density polyethylene may have a density from about 0.91 to about 0.94 g/cm$^2$ and a melting point from 120° C. to about 125° C. (ASTM D 2117). Linear low density polyethylene is known to those skilled in the art, and appropriate ones may be readily chosen. The amount of the linear low density polyethylene in the partition layer is up to 95% of the total amount of the partition strip.

While the thickness of the partition strip may vary, when a single layer partition strip is used the total thickness is from about 1.0 mils to about 4.0 mils, preferably about 1.4 to about 2.0 mils. When a two-layer strip is used the heat sealable blended layer thickness is from about 0.2 mils to about 0.6 mils and the total thickness is from 1.0 to 4.0 mils. It should be understood that the total thickness and layer thickness of the partition strip will depend upon the rupture strength desired.

Figure 3:
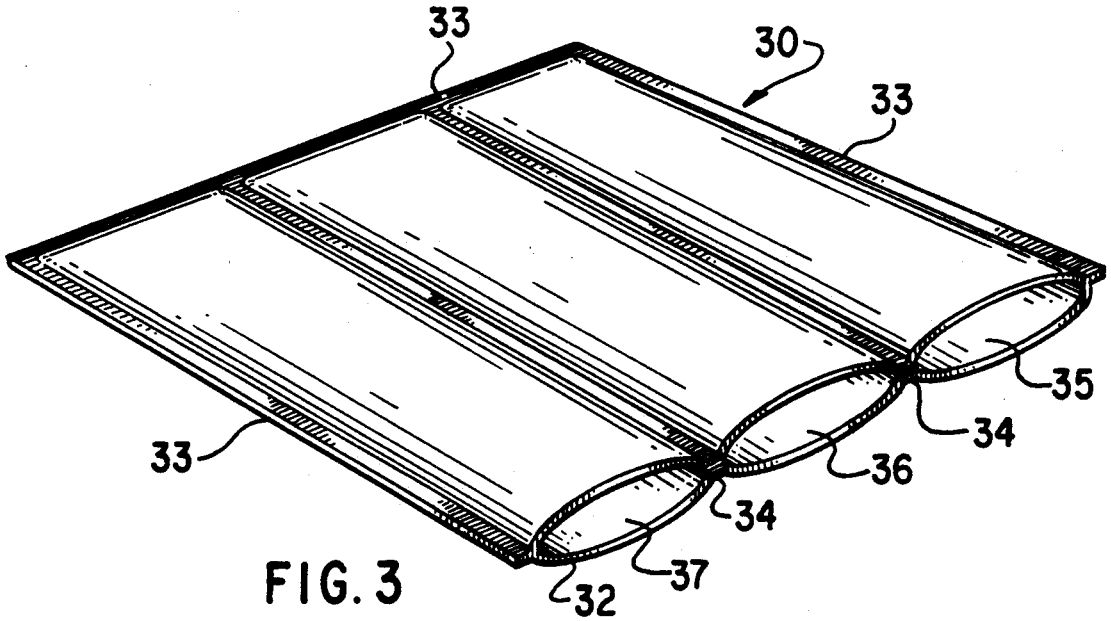
FIG. 3 is an isometric view of another embodiment of the package of the present invention illustrating three compartments.

FIG. 3 illustrates an embodiment of the present invention wherein the multi-compartment package has three compartments. A pouch is initially formed by heat sealing the peripheral edges 33 of juxtaposed thermoplastic sheets 31 and 32. A plurality of releasable partition strips 34 divide the pouch into three separate compartments. The compartments may be filled and heat sealed across the ends of openings 35, 36, and 37.

In order to mix the products in the different compartments, the user needs merely to apply nominal pressure to the package such that the easy open seal separating the compartments is ruptured. Note that the entire package is surrounded by a permanent seam which will not rupture under nominal pressures. The contents are mixed by rupturing the seal and chemically combining or shaking or, squeezing the package. The package may then be opened in the normal fashion and the mixed and/or reacted contents used. Although many uses for the multi-compartment packages of this invention will involve liquids in the several compartments, it should be understood that this packaging may also be used with gels, solids and combinations of materials in different forms.

The following example illustrates the utility and flexibility of the present invention.

EXAMPLE

A pouch for non-food application was formed from two sheets (10"×34") of conventional film comprising a 1.0 mil biaxial nylon layer having a (PVDC) Saran® polymer coating thereon. Three samples of a package were made using various sealing conditions. The two sheets were heat sealed on three sides on a Vertrod Sealing Machine at the conditions shown in the Table. A one-inch wide two-layer partition strip was used comprising a layer of linear low density polyethylene and a layer of a blend of 5% by weight polypropylene, 15% by weight polybutylene, and 80% linear low density polyethylene. The partition strip had a thickness of 3.0 mils and was placed lengthwise between the layers and heat sealed to form two compartments as shown in FIG. 1. Each compartment was filled with air (for testing purposes) and the top edge heat sealed. The sealed package was tested in an Instron tester for tensile strength and for burst air pressure strength. The results are shown in the Table below.

TABLE 1

| Sample | Seal | Vertrod Setting Heat Time | Vertrod Setting Dwell Time (sec) | Tensile Strength (lbs) | Burst Strength (in $H_2O$) |
|---|---|---|---|---|---|
| 1 | Permanent | 5 | 3 | 5.7 | 60 |
| | EZ open | 3 | 3 | 0.5 | 15 |
| 2 | Permanent | | (Premade) | 9.7 | 57 |
| | EZ open | 3 | 3 | 0.5 | — |
| 3 | Permanent | 5 | 3 | over 10 | over 100 |
| | EZ open | 3 | 3 | 0.5 | — |

As shown by the results in the Table the partition strip ruptured with considerably less force than the perimeter seals.

Although illustrated embodiments of this invention have been described in detail hereinabove with reference to the accompanying drawings, it is to be understood that the invention is not limited to those precise embodiments, and that various changes and modifications may be readily effected by persons of ordinary skill without departing from the spirit or scope of this invention which is to be defined by the appended claims.

As used herein, "tie layer" is a term well known in the art for "adhesive layer".

What is claimed is:

1. A multi-compartment package formed of flexible thermoplastic material, suitable for filling with materials which are to be stored in isolation from each other, comprising:

a pouch formed of thermoplastic film material positioned in overlying relationship and permanently heat sealed on all but one edge thereof, at least one partition strip positioned between the sheets of thermoplastic film in such manner as to form at least two separate compartments, the open side being sealed after filling said compartments, whereby a rupturable seal between the resulting compartments is formed, said partition strip comprising at least one layer of heat sealable material being rupturable under nominal pressure allowing the products in each compartment to mix, said heat sealable layer of said partition strip comprising a blend of polypropylene, polybutylene and linear low density polyethylene.

2. The multi-compartment package according to claim 1 wherein said partition strip comprises from about 2% to about 10% by weight polypropylene, from about 5% to about 30% polybutylene by weight, and from about 60% to about 93% by weight linear low density polyethylene.

3. The multi-compartment package according to claim 2 wherein said partition strip has a thickness of from about 1.0 mils. to about 2.0 mils.

4. The multi-compartmented package according to claim 3 wherein said flexible thermoplastic film is from about 0.75 mils to about 5.0 mils thick.

5. The multi-compartmented package according to claim 4 wherein said flexible thermoplastic film is from about 1.25 mils to about 4.0 mils thick.

6. The multi-compartmented package according to claim 1 wherein said partition strip further comprises a second layer of linear low density polyethylene.

7. The multi-compartment package according to claim 6 wherein said partition strip first layer has a thickness of from about 0.75 mils to about 4.0 mils, and said second layer has a thickness of from 0.2 mils to 0.6 mils.

8. The multi-compartment package according to claim 1 wherein said flexible thermoplastic material is a multi-layered structure having layers selected from the group comprising polyolefin, EVOH, PVDC, ionomer, and polyamide polymers.

* * * * *